US006237546B1

(12) United States Patent
Gander

(10) Patent No.: US 6,237,546 B1
(45) **Date of Patent: *May 29, 2001**

(54) REVERSIBLE INTERNAL COMBUSTION ENGINE

(75) Inventor: Hans Gander, Bad Urach (DE)

(73) Assignee: DaimlerChrysler AG, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,591

(22) Filed: Jun. 3, 1999

(30) Foreign Application Priority Data

Jun. 6, 1998 (DE) ..... 198 25 411

(51) Int. Cl.[7] ..... F01L 13/02
(52) U.S. Cl. ..... 123/41 E
(58) Field of Search ..... 123/41 R, 41 E

(56) References Cited

U.S. PATENT DOCUMENTS 3,981,278 9/1976 Harada .
4,009,695 3/1977 Ule .
4,038,825 * 8/1977 Bastenhof et al. ..... 123/41 R
5,036,802 8/1991 D'Amours .

FOREIGN PATENT DOCUMENTS 32 45 585 6/1984 (DE) .
2 616 481 12/1988 (FR) .
426 300 4/1935 (GB) .
988 971 4/1965 (GB) .
1 292 841 10/1972 (GB) .
1 345 856 2/1974 (GB) .

* cited by examiner

*Primary Examiner*—Noah P. Kamen
(74) *Attorney, Agent, or Firm*—Klaus J. Bach

(57) ABSTRACT

In a reversible-type internal combustion engine including electromagnetically operated gas change valves and a control unit for controlling actuation of the gas change valves, a direction of rotation switch is actuated to reverse engine rotation whereupon the engine is slowed down and uncoupled from the associated drive line and, when the engine speed falls below a predetermined value rotation of the engine in opposite direction is initiated while the timing of the electromagnetically controlled valves is adjusted to the opposite direction of rotation of the internal combustion engine.

7 Claims, 1 Drawing Sheet

REVERSIBLE INTERNAL COMBUSTION ENGINE

BACKGROUND OF THE INVENTION

The invention relates to a reversible reciprocating internal combustion engine with intake and exhaust valves.

Reciprocating internal combustion engines are generally operated only in one direction of rotation. If in a certain application, for example, in motor vehicles, motive power in both direction of rotation is needed, the internal combustion engine is generally provided with a reversing transmission, which can be shifted with interruption of the transmission of power or under load.

DE 26 34 916 C2 discloses a reversible piston-type internal combustion engine, which is capable of operating in both directions of rotation. To change its direction of rotation, the internal combustion engine is shut down and stopped and the timing of the intake and exhaust valves is changed for the new direction of rotation by axially moving a camshaft operating the valves so that cams specifically provided for the new direction of operation become effective. In internal combustion engines with external ignition also the ignition timing must be adapted to the new direction of rotation. Reversible internal combustion engines are used especially in connection with ships, particularly ships having low-speed Diesel engines, which drive a ship propeller directly without intermediate transmission. Such reversible arrangements have been successfully used to avoid the need for transmissions and reversing transmissions in drives transmitting high torques and high power. In these application, there is generally sufficient time for reversing the direction of engine rotation. Also, such piston type internal combustion engines can be slowed down and restarted relatively rapidly by pressurized air.

U.S. Pat. No. 39 81 278 discloses an arrangement for the protection of reversible piston type internal combustion engines during rotation reversal of the engine. In this case, the engine speed and the direction of rotation at the time the reversing operation is initiated are determined.

In U.S. Pat. No. 5 036 802, a method is disclosed, whereby the direction of rotation of a two-cycle engine with external ignition can be reversed. During reversal, the ignition is interrupted, the speed of the crankshaft is continuously reduced and, at the same time, monitored. When the speed falls below a predetermined value and before the engine is at a standstill, the ignition is reactivated, but with a sufficiently large ignition angle before the top dead center position of the respective piston that the forces generated are sufficiently large to drive the piston back down before it reaches the top dead center position. Then the engine rotates in the opposite direction and the ignition is set to a normal value corresponding to the new direction of rotation. Such a reversal of engine rotation is to be used in connection with snowmobiles, which change their direction of movement relatively frequently. The reversal of the direction of engine rotation is performed automatically when an operating switch is activated. The internal combustion engine does not need to be stopped for that purpose.

However, the known reversal arrangements and methods are not suitable for motor vehicles with valve controlled reciprocating internal combustion engines.

Electromagnetic actuators for operating gas change (intake and exhaust) valves are generally known for example from DE 39 20 976 Al. They include generally two operating magnets, that is a valve opening magnet and a valve-closing magnet between whose pole faces an armature is arranged so as to be movable coaxially with a valve shaft. The armature acts directly or indirectly on a valve shaft of the gas change valve by way of an armature plunger. Actuators operating in accordance with the principle of a mass oscillator include a pre-tensioned spring mechanism engaging the armature. As spring mechanism generally two pre-tensioned compression springs are used, that is, an upper valve spring which serves as a valve opening spring and which generates a force in valve opening direction and a lower valve spring which serves as a valve closing spring and generates a force in the valve closing direction. If the magnets are not energized, the armature is held by the valve springs in an equilibrium position between the magnets. With such actuators gas change valves can be controlled individually as desired.

It is the object of the present invention to simplify the reversal of rotation of reciprocating internal combustion engines and to make such arrangements suitable for use in motor vehicles with valve controlled engines.

SUMMARY OF THE INVENTION

In a reversible-type internal combustion engine including electromagnetically operated gas change valves and a control unit for controlling actuation of the gas change valves, a direction of rotation switch is actuated to reverse engine rotation whereupon the engine is slowed down and uncoupled from the associated drive line and, when the engine speed falls below a predetermined value, rotation of the engine in opposite direction is initiated while the timing of the electromagnetically controlled valves is adjusted to the opposite direction of rotation of the internal combustion engine.

With this arrangement, the timing of the gas change valves can be adjusted to a new direction of operation rapidly and in a simple manner.

The reversing procedure required herefor is preferably performed by a control unit which monitors the required parameters by way of sensors and processes them to provide the respective control signals for the actuators, a starter and, if needed, an ignition system and a brake. After interruption of the power transmission by way of a clutch, the fuel supply and, if present, the external ignition are interrupted. The piston type internal combustion engine is then slowed down by internal friction forces until the engine speed has fallen below a value at which the actual reversal can occur. At that point the piston-type internal combustion engine can be started in the opposite direction of rotation. In order to accelerate this process, it is advantageous to provide the engine additionally with a primary brake, for example, a friction brake, a primary retarder, an exhaust gas brake or similar system. Similar results can be achieved according to an embodiment of the invention also in that the actuators for slowing down the piston-type internal combustion engine are placed into a braking mode. To this end, the timing for the gas change valves is so changed that the compression losses and gas change losses of the internal combustion engine are as large as possible.

The piston type internal combustion engine may also be slowed down by the vehicle by interrupting the drive train only when the predetermined engine speed is below the predetermined value. However, since the smaller mass of the engine alone can be braked faster than the larger mass of the vehicle, the time difference can be utilized for the reversing process so that the drive train connection can be re-established without delay as soon as the vehicle has reached the acceptable speed.

Further advantages of the invention will become apparent from the following description of an embodiment of the invention on the basis of the accompanying drawings. The description and the claims cover various features in a combination. The expert will consider the features individually and may combine them in additional embodiments.

DESCRIPTION OF A PREFERRED EMBODIMENT

Figure 1:
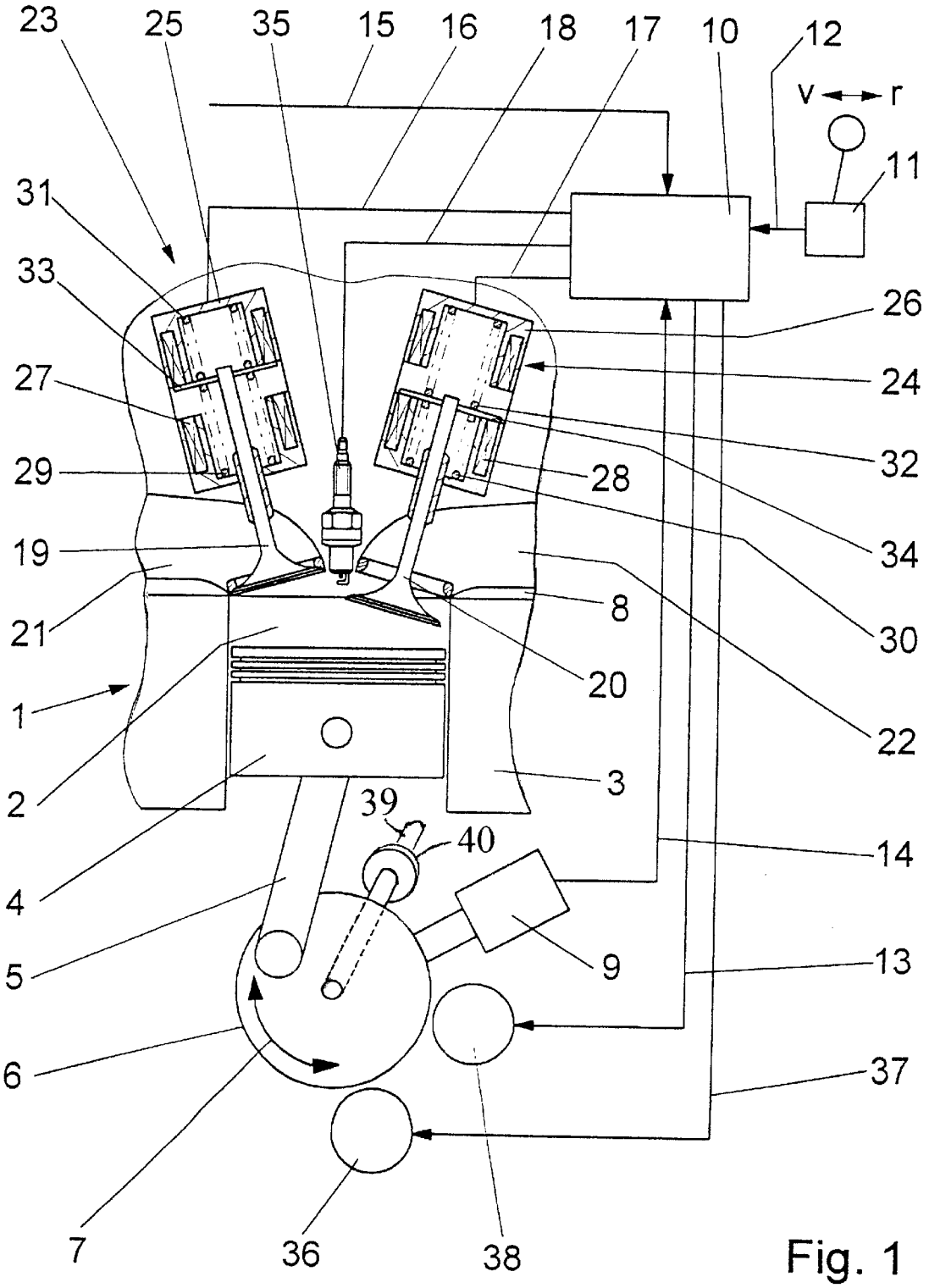
FIG. 1 is a schematic cross-sectional view of a reciprocating internal combustion engine.

A piston-type internal combustion engine 1 comprises a cylinder block 3 including a cylinder 2. A piston 4 is movably disposed in the cylinder 2 and is connected to a crankshaft 6 by way of a connecting rod 5.

The cylinders 2 are closed by a cylinder head 8, which includes for each cylinder at least two gas change valves 19, 20, one intake valve and one exhaust valve, which control the respective gas flow passages. The gas change valves 19, 20 are operated by electromagnetic actuators 23 and 24, which include each an upper closing magnet 25, 26 and a lower opening magnet 27, 28, which act on the gas change valves 19, 20 by way of an armature 33, 34 disposed between the magnets 25, 26 and 27, 28. The actuators 23, 24 are aided by spring systems which each include a closing spring 29, 30 and an opening spring 31, 32 and which act on the gas change valve in accordance with a springmass oscillator.

The piston-type internal combustion engine 1 can be operated in both directions of rotation 7 by reversal of its direction of rotation. For this purpose, a control unit 10 is provided which is connected to a direction of rotation and standstill monitor 9 by a signal line 14, to a direction of driving switch 11 with a position v for forward and a position r for reverse by a signal line 12, and with a vehicle speed sensor, which is not shown, by a signal line 15. Additional sensors, which are suitable for a safe control of the reversing procedure may be connected to the control unit 10.

The control unit 10, which may include a microprocessor processes the signals supplied thereto on the basis of characteristic values, characteristic curves and/or performance graphs. The control unit forms output signals, which control the actuators 23, 24 by way of the control lines 16, 17, the ignition system, if present, by way of a control line 13. Another control line 37 is provided for a brake 36. A fuel flow measuring device, which is also controlled by the control unit 10, is not shown in the figure as it is preferably part of the electronic engine control system.

When the direction of driving switch 11 is operated, the control unit 10 interrupts the fuel supply to the engine 1 and the drive line 39 to the vehicle suitably by actuating a clutch 40 (shown schematically). In an engine with an external ignition system, also the power supply to the spark plug 35 is interrupted. When the rotational speed of the crankshaft 6 falls below a predetermined value, which is sensed by the direction of rotation and stand-still monitor 9 and signaled to the control unit 10 and which is interpreted by the monitor 9 as stand-still of the engine, the actuators 23, 24 and the spark plug 35 are controlled in accordance with a new cycle and the starter 38 is energized to re-start the internal combustion engine in the new direction of rotation. Subsequently, the drive connection between the internal combustion engine 1 and the vehicle is re-established. Internal combustion engines with eternal ignition may be started in the new direction of rotation without the use of a starter motor 38 by setting the external ignition to an early ignition point when the engine speed falls below a predetermined value.

In order to accelerate the procedure, the internal combustion engine 1 may be slowed down by an additional brake 36. The brake 36 may be a primary retarder, an exhaust gas brake or a friction brake. Furthermore, a generator can be utilized to brake down the engine, wherein the braking force may be controlled by the power consumption of the generator. Instead of the brake 36, or in combination therewith, the actuators 23, 24 may be operated in a braking mode. In this mode, the gas change valves are so controlled that the internal combustion engine has high internal losses. This can be achieved, for example, in that the intake valves and exhaust valves are opened very late so that, during the intake stroke, a high vacuum is generated in the cylinder and the piston operates against a high compression pressure during the exhaust stroke. With the internal combustion engine 1 according to the invention, a reversing gear set in the transmission can be eliminated. The change-over from forward to reverse operation is fully automated. It is also possible to operate the vehicle in forward or in reverse at all the transmission ratios. However, it is preferred to limit reverse operation to transmission ratios, which insure safe reverse operation.

What is claimed is:

1. A method of operating an internal combustion engine with fuel injection including a piston movably disposed in a cylinder, gas change valves and electromagnetic actuators for operating said gas change valves, a control unit for controlling actuation of said gas change valves, a direction of movement switch for providing to said control unit a signal indicating the desired direction of rotation of said internal combustion engine, and a direction of rotation monitor associated with said engine for providing a direction of rotation signal and a stand still signal of said engine, as well as a signal indicating the position of the respective piston and supplying said signals to said control unit for the processing of said signals to form a control signal controlling said electromagnetic actuators, wherein, upon changing the position of said direction of movement switch to reverse the direction of movement of the vehicle by driving the vehicle with reverse rotation of said engine, the engine is uncoupled from an associated drive line, the fuel injection and, if the engine has an external ignition system, the ignition is interrupted and the internal combustion engine is braked at a rate exceeding the vehicle slow-down rate and, when the engine speed falls below a predetermined value, the intake valve and exhaust valve opening and closing times are changed in accordance with the desired direction of rotation, fuel injection and ignition are reestablished also in accordance with the desired direction of rotation, the engine is restarted in the opposite direction of rotation all while the vehicle is still being slowed down and, the engine is then re-coupled to said drive line when the travel speed of a vehicle, in which the engine is installed, falls below a predetermined value.

2. A method according to claim 1, wherein said internal combustion engine is restarted by a starter motor which can be operated in both directions of operation and which is energized depending on a control signal of the control unit.

3. A method according to claim 1, wherein said internal combustion engine is started in the opposite direction of rotation by setting the ignition timing of an external ignition system to early ignition when the engine speed has dropped below a predetermined value.

4. A method according to claim 1, wherein said engine is slowed down by a brake associated with said engine before reverse engine rotation is initiated.

5. A method according to claim 1, wherein said engine is slowed down by an electric generator before reverse engine rotation is initiated.

6. A method according to claim 1, wherein said engine is slowed down by operating said valve actuators in a braking mode.

7. A method according to claim 1, wherein reversing of said engine operation is permitted only at predetermined transmission ratios.

* * * * *